US006135731A

United States Patent [19]

Woollenweber et al.

[11] Patent Number: 6,135,731

[45] Date of Patent: Oct. 24, 2000

[54] COMPACT AND SELF-COOLING BLOWER ASSEMBLY

[75] Inventors: William E. Woollenweber, Carlsbad; Edward M. Halimi, Montecito, both of Calif.

[73] Assignee: Turbodyne Systems, Inc., Carpinteria, Calif.

[21] Appl. No.: 08/883,531

[22] Filed: Jun. 26, 1997

[51] Int. Cl.[7] ..... F04B 17/00

[52] U.S. Cl. ..... 417/423.14; 417/423.8; 417/423.15; 415/912

[58] Field of Search ..... 417/423.14, 423.15, 417/423.8, 238; 415/912; 416/146 R

[56] References Cited

U.S. PATENT DOCUMENTS

| | | | |
|---|---|---|---|
| 2,078,499 | 4/1937 | Ljungstrom . | |
| 2,173,489 | 9/1939 | Voigt . | |
| 2,578,785 | 12/1951 | Davis . | |
| 2,649,048 | 8/1953 | Pezzillo et al. . | |
| 2,782,721 | 2/1957 | White . | |
| 2,829,286 | 4/1958 | Britz . | |
| 3,115,839 | 12/1963 | Pollak et al. | 417/423.14 |
| 3,163,790 | 12/1964 | White . | |
| 3,543,368 | 12/1970 | Marlow | 415/912 |
| 3,557,549 | 1/1971 | Webster . | |
| 3,572,982 | 3/1971 | Kozdon . | |
| 3,841,791 | 10/1974 | Doolin | 415/912 |
| 3,935,625 | 2/1976 | Saterdal | 415/912 |
| 3,961,199 | 6/1976 | Bronicki . | |
| 4,115,038 | 9/1978 | Litzenberg | 415/912 |
| 4,445,337 | 5/1984 | McCreary . | |
| 4,453,381 | 6/1984 | Dinger . | |
| 4,565,505 | 1/1986 | Woollenweber . | |

(List continued on next page.)

FOREIGN PATENT DOCUMENTS

| | | |
|---|---|---|
| 295985 | 12/1988 | European Pat. Off. . |
| 367406 | 9/1990 | European Pat. Off. . |
| 2479899 | 9/1981 | France . |
| 57-212331 | 12/1982 | Japan . |
| 58-222919 | 12/1983 | Japan . |
| 59-49323 | 3/1984 | Japan . |
| 3202633 | 4/1991 | Japan . |
| 4-112921 | 4/1992 | Japan . |
| 5-5419 | 1/1993 | Japan . |
| 267149 | 8/1927 | United Kingdom . |
| 308585 | 3/1929 | United Kingdom . |

OTHER PUBLICATIONS

SAE Technical Paper 940842 "Turbo–Compound Cooling Systems for Heavy–Duty Diesel Engines", 1994, W.E. Woollenweber.

Proc. Instn. Mech Engrs. vol. 189, 43/75, "Experimental and Theoretical Performance of a Radial Flow Turbocharger Compressor with Inlet Prewhirl", 1975, pp. 177–186, F.J. Wallace, et al.

*Primary Examiner*—Timothy S. Thorpe
*Assistant Examiner*—Cheryl J. Tyler
*Attorney, Agent, or Firm*—Brinks Hofer Gilson & Lione

[57] ABSTRACT

A compact air blower assembly operates efficiently at high speeds, such as 10,000 to 12,000 rpm, and can be inexpensively manufactured from a common set of blower parts to provide varied airflow capacities, and satisfy a variety of applications. The compact multi-use air blower assembly is provided by a high speed brushless electric motor comprising a stator and a rotor and rotatable shaft carried by a pair of shaft bearings, with the rotatable shaft including a shaft extension extending outwardly from one of the shaft bearings. A housing includes a first portion electric motor and shaft bearings and a second portion surrounding the first portion, forming a blower enclosure about the shaft extension with a centrally located air inlet and a peripherally located air outlet. The blower enclosure encompasses a centrifugal blower wheel including a solid wall extending radially outwardly from a shaft-engaging hub and forming a plurality of air-moving blades projecting axially outward from the wall to edge portions that extend radially within the blower enclosure between the air inlet and the air outlet.

9 Claims, 3 Drawing Sheets

U.S. PATENT DOCUMENTS

| | | |
|---|---|---|
| 4,641,977 | 2/1987 | Woollenweber . |
| 4,708,095 | 11/1987 | Luterek . |
| 4,708,602 | 11/1987 | McEachern, Jr. et al. . |
| 4,776,168 | 10/1988 | Woollenweber . |
| 4,827,170 | 5/1989 | Kawamura et al. . |
| 4,850,193 | 7/1989 | Kawamura . |
| 4,878,347 | 11/1989 | Kawamura . |
| 4,882,905 | 11/1989 | Kawamura . |
| 4,885,911 | 12/1989 | Woollenweber et al. . |
| 4,894,991 | 1/1990 | Kawamura . |
| 4,901,530 | 2/1990 | Kawamura . |
| 4,918,923 | 4/1990 | Woollenweber et al. . |
| 4,935,656 | 6/1990 | Kawamura . |
| 4,955,199 | 9/1990 | Kawamura . |
| 4,958,497 | 9/1990 | Kawamura . |
| 4,958,708 | 9/1990 | Kawamura . |
| 4,981,017 | 1/1991 | Hara et al. . |
| 4,998,951 | 3/1991 | Kawamura . |
| 5,025,629 | 6/1991 | Woollenweber . |
| 5,038,566 | 8/1991 | Hara . |
| 5,074,115 | 12/1991 | Kawamura . |
| 5,088,286 | 2/1992 | Muraji . |
| 5,094,587 | 3/1992 | Woollenweber . |
| 5,121,605 | 6/1992 | Oda et al. . |
| 5,176,509 | 1/1993 | Schmider et al. . |
| 5,406,979 | 4/1995 | Kawamura . |
| 5,560,208 | 10/1996 | Halimi et al. . |
| 5,605,045 | 2/1997 | Halimi et al. . |
| 5,785,013 | 7/1998 | Sinn et al. ..... 417/423.14 |

COMPACT AND SELF-COOLING BLOWER ASSEMBLY

FIELD OF THE INVENTION

This invention relates to blower assemblies, and more particularly relates to compact air blower assemblies, particularly for use as components to supply air to heating system burners.

BACKGROUND OF THE INVENTION

Fuel burning heating systems in general use today frequently consist of a burner that is supplied with air for combustion from a motor-powered fan or blower assembly. Typically, the air suppliers for heating system burners may be radial airflow devices driven by conventional electric motors taking power from commercial electrical supply lines. In the United States, commercial electrical power is supplied typically at 110 and 220 volts at 60 cycles, and in many foreign countries electrical power is supplied typically at 220 volts at 50 cycles, and such electric power supplies operate the electric motors driving the air suppliers at speeds on the order of 2500 to 3500 rpm. At such low speeds, the size of the motor driven blower is large in order to supply the amount of air required for combustion of the fuel.

One type of blower which is commonly used is called a Sirocco blower in which air is drawn into the center of a cylindrical, cage-like air-moving wheel by its rotation and is forced radially outwardly from the center by curved vanes that extend along the axis of rotation at the cylindrical periphery of the air-moving wheel. A scroll-like casing surrounds the cylindrical periphery of the air-moving wheel to collect the air outflow and direct it tangentially through a peripheral outlet for delivery to the fuel burning chambers of a furnace. Operating at speeds of 2500 to 3500 rpm Sirocco blowers are large in size in order to deliver a sufficient air for fuel combustion in most heating systems. In addition, due to their poor aerodynamic shape, the efficiency of such blowers can be as low as 10 to 15 percent.

BRIEF SUMMARY OF THE INVENTION

The invention provides an air blower assembly that is compact and operates efficiently at high speeds, and that can be inexpensively manufactured from a common set of blower parts to provide varied airflow capacities, and satisfy a variety of applications.

In the invention, a compact multi-use air blower assembly is provided by a high speed brushless electric motor comprising a stator and a rotor and rotatable shaft carried by a pair of shaft bearings, with the rotatable shaft including a shaft extension extending outwardly from one of the shaft bearings. A housing includes a first portion carrying the electric motor and shaft bearings and a second portion forming a blower enclosure about the shaft extension with a centrally located air inlet and a peripherally located air outlet. The blower enclosure encompasses a centrifugal blower wheel including a solid wall extending radially outwardly from a shaft-engaging hub and forming a plurality of air-moving blades projecting axially outward from the wall to edge portions that extend radially within the blower enclosure between the air inlet and the air outlet. The high speed brushless electric motor can rotate such a centrifugal blower wheel at high speeds, for example, 10,000 to 12,000 rpm to provide airflow more efficiently from a substantially more compact housing, occupying for example, from about 12 to about 50 percent of the volume of Sirocco type blowers of the same capacity.

The invention permits the manufacture of blower assemblies having a multiplicity of capacities and applications from a common set of parts by providing, in such blower assemblies, a centrifugal blower wheel in which the plurality of air-moving blades project a sufficient axial distance from the wall to their radially extending end portions that they permit reduction of their axial widths and a selectable location of the centrifugal blower wheel and its radially extending wall within the blower enclosure to provide a variety of air output capacities from operation of a single motor.

In addition, in preferred blower assemblies of the invention, the second portion of the housing can form a blower enclosure extending rearwardly from the centrifugal blower wheel and around the first housing portion carrying the electric motor to thereby provide a flow of cooling air for the electrical motor housing, permitting more power to be extracted from the electric motor for any given size by the resulting dissipation of the electric motor heat loss and/or a reduction of the temperature of the electric motor components.

Other features and advantages of the invention will be apparent from the drawings and the more detailed description of the invention that follows.

DETAILED DESCRIPTION OF THE BEST MODE OF THE INVENTION

Figure 1:
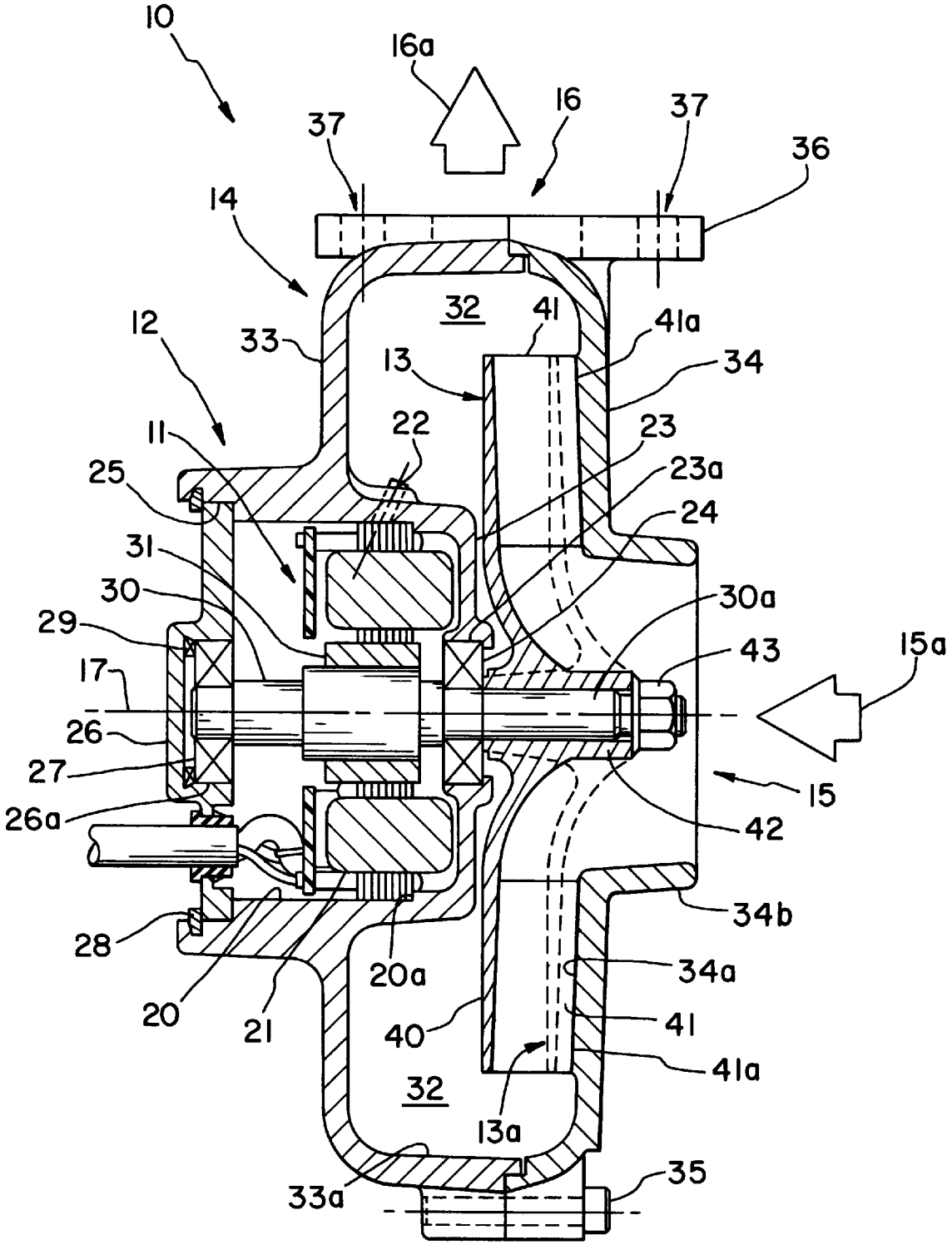
FIG. 1 is a cross-sectional view of a blower assembly of the invention taken at a plane through the axis of rotation.
Figure 2:
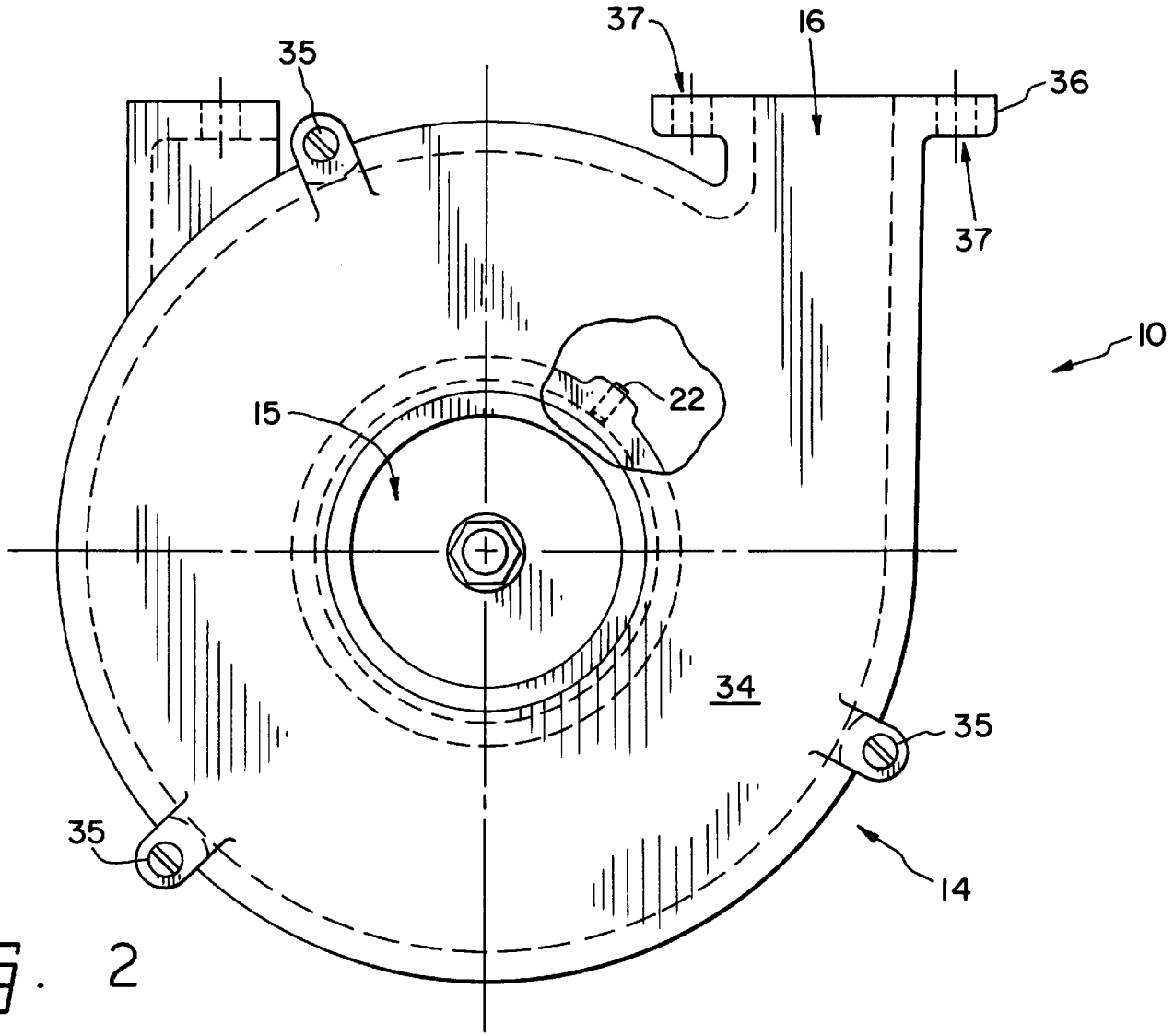
FIG. 2 is a side view of the blower assembly of FIG. 1 as seen from the right of FIG. 1.
Figure 3:
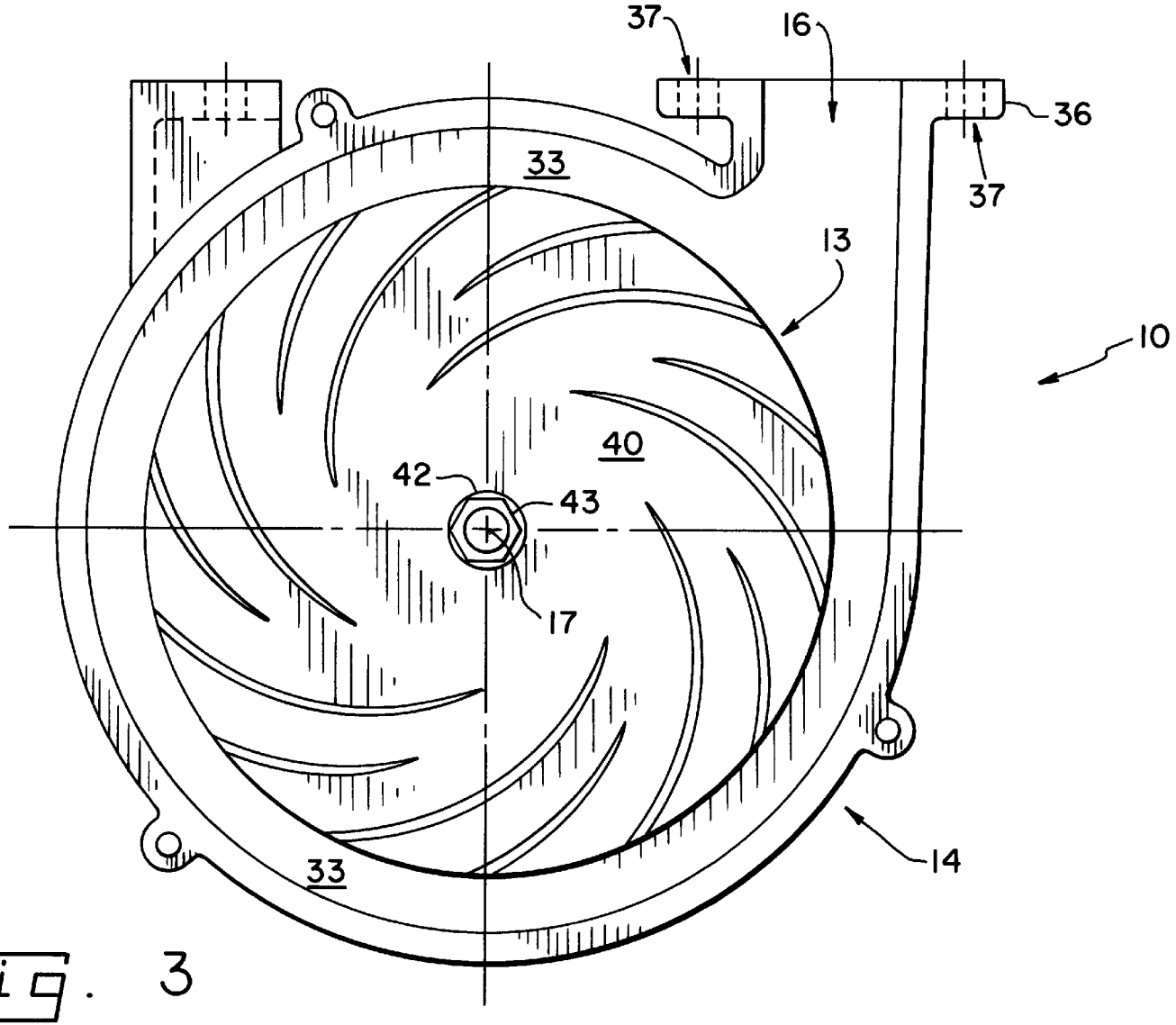
FIG. 3 is a view of the blower assembly of FIGS. 1 and 2 with the part of the blower enclosure removed to illustrate the centrifugal blower wheel of the preferred embodiment.

FIGS. 1–3 illustrate a preferred embodiment 10 of the invention. As shown in FIG. 1, a preferred blower assembly of the invention includes a high speed brushless electric motor 11 carried by a first housing portion 12 driving a centrifugal blower wheel 13 within a second housing portion 14. In the invention, rotation of the blower wheel 13 at high speeds, such as 12,000 rpm, efficiently draws air into the blower assembly air inlet 15 as indicated by arrow 15*a*, and expels the air from air outlet 16, as indicated by arrow 16*a*. As explained further below, the invention permits blower assemblies to be matched to varied uses and applications with varied air delivery requirements with identical cast parts by merely machining a single blower wheel casting. For example, FIG. 1 indicates a centrifugal blower wheel 13*a* (shown in dashed lines), machinable from the same casting as blower wheel 13 (shown in solid lines), but in the blower assembly 10 providing a substantially reduced airflow from outlet 16 when driven by motor 11.

We may on occasion refer to an "axial direction" and use the word "axially" in this description and in doing so, we mean in a direction substantially parallel to the axis of rotation 17 of the blower assembly. In addition, for convenience in this description of the invention, we will refer to the side of the blower assembly 10 in which the air inlet 15 is located as being "forwardly", and in the "front" portion of the assembly and as representing a "forward" direction, and we will refer to the direction of the portion of the blower assembly 10 including the electric motor 11 and the first housing portion 12 as being "rearwardly", and in the "rear"

portion and as representing a "rearward" direction. The application of this forward and rearward nomenclature to the blower assembly 10 is merely so that features may be conveniently described, and those skilled in the art will recognize this nomenclature has no other functional meaning and could easily be reversed in describing the invention.

As illustrated more specifically in FIG. 1, the first portion 12 of the housing carries the electric motor 11 within a circumferential wall portion 20 that extends axially along the axis of rotation 17 of the motor 11 and blower wheel 13, and includes an internal surface 20*a* for engaging and supporting the stator 21 of the electric motor 11. The stator 21 may be conveniently retained within the first housing portion 12 by a setscrew 22 which is positioned to engage the magnetic laminations of the stator 21. The first housing portion 12 further includes a radially inwardly extending forward wall portion 23 having a first circumferential surface 23*a* for engaging and supporting one bearing 24 of a pair of shaft bearings. The rearward portion of the first housing portion 12 includes a second circumferential locating surface 25 for engaging and supporting a separate end portion 26 which itself includes a circumferential locating surface 26*a* for engaging and supporting the other bearing 27 of the pair of bearings. The separate end bell 26 can be retained in the first housing portion 12 by, for example, a snap ring 28.

The bearings 24 and 27 are thus located and supported by the first housing portion 12 for carrying the rotatable shaft 30 and the rotor 31 of the electric motor within the electric motor stator 21 so that application of electric power to the stator 21 and a resulting rotating field created by the stator 21 acting on rotor 31 will drive the centrifugal blower wheel 13 in rotation at high speeds. As indicated in FIG. 1, bearings 24 and 27 are preferably ball bearings and axial loading for the ball bearings can be supplied by a spring 29.

As shown in FIG. 1, the rotatable shaft 30 includes a shaft extension 30*a* extending beyond the one bearing 24 of the pair of bearings where it is surrounded by the forwardmost portion of the second housing portion 14. As further illustrated in FIG. 1 the second housing portion 14 forms a blower enclosure and an air chamber 32 encompassing the centrifugal blower wheel 13. The walls of the second housing portion 14 forming the blower enclosure direct the air drawn through air inlet 15 by the rotating centrifugal blower wheel 13 (as indicated by arrow 15*a*) through the air chamber 32 and outwardly through air outlet 16 (as indicated by arrow 16*a*).

In the preferred embodiment of FIGS. 1–3, the second housing portion 14 includes a first blower enclosure wall 33 extending radially outwardly from the first housing portion 12 at a location adjacent the rearward end of the stator 21 carried by the first housing portion 12. The first blower enclosure wall 33 extends forwardly from this location in a portion 33*a* surrounding the centrifugal blower wheel 13. Thus, the second housing portion 14 forms the blower enclosure with an air chamber 32 surrounding the motor-carrying portion of the first housing portion 12 so that air circulating within the air chamber 32 will cool the first housing portion 12 that engages and carries the stator 21 of the electric motor 11, dissipating the heat losses of the electric motor 11 and reducing the temperature of the motor parts, permitting more power to be extracted from an electric motor of a given size and efficiency, and the size of the first housing portion 12 to be correspondingly reduced, and permitting motors of any given size and efficiency to be operated at lower temperatures. As indicated in FIG. 1, the axially extending circumferential part 20 of the first housing portion 12 between the air chamber 32 and the electric motor 11 can have a reduced thickness to facilitate heat transfer from the electric motor 11 to the air being urged through air chamber 32 by the rotating centrifugal blower wheel 13.

The front part of the second housing portion 14 is preferably a second separate element 34 which may be fastened to the wall portion 33*a* of the second housing portion 14 by a plurality of threaded fasteners 35 as shown in FIGS. 1 and 2. The front part 34 of the second housing portion 14 provides an inner air chamber wall 34*a* cooperating with the centrifugal blower wheel 13 and, in the preferred embodiment, a forwardly extending portion 34*b* forms the air inlet 15. In the preferred embodiment shown, the air outlet 16 is preferably formed by the periphery of wall portion 33*a* and the second separate element 34, and the wall portions 33 and 34 of the second housing portion 14 can be formed with a flange 36 including a plurality of openings 37 permitting the blower assembly to be mounted directly to a furnace casing where air can be delivered to its burner cavity to mix with atomized fuel for combustion. The outlet flange 36 is further illustrated in FIGS. 2 and 3. Because of their compact size and lightweight, blower assemblies of the invention may be conveniently mounted to a furnace assembly, or to any other apparatus needing a supply of air, by 2 or 3 threaded fasteners applied through holes 37 of the outlet flange 36.

As shown in FIGS. 1 and 3, the centrifugal blower wheel 13 includes a solid back wall 40 and a plurality of air-moving blades 41 projecting axially forwardly from the wall 40 and terminating in radially extending edge portions 41*a* that, in the preferred embodiment, can lie closely adjacent the inside surface 34*a* of the blower enclosure forming the air chamber 32. Wall 40 extends radially outwardly from a shaft-engaging hub portion 42 which is carried by the shaft extension 30*a*. The shaft-engaging hub 42 and centrifugal blower wheel 13 are clamped for rotation with the rotating shaft 30 by a nut 43 fitted on the end of the shaft extension 30*a*.

As indicated above, the invention permits blower assemblies to be provided with varied air capacities with a single set of parts. This is accomplished in the invention by providing a centrifugal blower wheel 13, which can be conveniently die cast from aluminum, with air-moving blades 41 that project axially forwardly from the wall 40 a distance greater than the distance between the forwardmost face of the front wall 23 of the first housing portion 12 and the rear facing surface 34*a* of the forward part 34 of the second housing portion 14. In addition, the cast blower wheel can have a shaft-engaging hub portion 42 extending rearwardly of the wall 40 a distance substantially equal to or greater than the axially extending width of the air-moving blades 41, as indicated generally by the dashed lines of FIG. 1. As further indicated in FIG. 1, the shaft-engaging hub 42 can extend forwardly of the wall 40 for a distance substantially equal to or greater than the axial width of the air-moving blades 41, as indicated generally by the solid lines of FIG. 1. Thus, by casting a part for the manufacture of the centrifugal blower wheel 13, which includes a plurality of air-moving blades 41 projecting from the wall 40 a distance substantially equal to or greater than that needed for their end portions 41*a* to be closely adjacent the forward inside wall portion 34*a* of air chamber 32 and which includes a shaft-engaging portion 42 extending forwardly and rearwardly of the wall 40 a distance substantially equal to or greater than the interval between the forwardmost surface of the first wall portion 23 and the rear facing surface 34*a* of the blower enclosure, the centrifugal blower wheel 13 may be selectively located within the blower enclosure formed by the second housing part 14 to provide blower assemblies having different air supply capacities. For example, by machining materials from the forward edge portions 41*a* of the air-moving blades 40 and the forward portion of the shaft-engaging hub 42 of such a blower wheel casting, a centrifugal blower wheel 13*a* (as shown by the dash lines of FIG. 1), can, for example, be provided and selectively located for reduced air requirements, and by way of further example, by removing material from the rearward portion of the shaft-engaging hub 42 and only enough material to finish the leading edges 41*a* of the air-moving blades 41 of such a blower wheel casting, a blower wheel 13 (as indicated in the solid lines in FIG. 1) can, for example, be provided and selectively located for higher air requirements. Thus, the invention can eliminate the need for different centrifugal blower wheel and enclosure castings for different air requirements, and the need for spacers, and permit a blower assemblies for multiple uses and applications and with varied air capacities to be inexpensively manufactured and with a minimum of parts and inventory. Of course, spacers can be used in the invention to clamp blower wheels to the rotating shaft if it is undesirable to provide an extended shaft-engaging hub portion on the blower wheel for machining as described above.

As indicated above, the blower assemblies of the invention are particularly adaptable for use on furnaces and other heating systems permitting a furnace manufacturer to inventory a common set of blower parts for installation on furnaces of various sizes and heating air requirements. For example, a blower assembly with the blower wheel as indicated in the dash lines 13*a* of FIG. 1 will be used with furnaces having a small air requirement whereas the blower assembly with the blower wheel as shown in solid lines in FIG. 1 will be used with furnaces requiring larger air requirements.

A blower assembly of the invention is compact and lightweight and can have a maximum outside dimensions of, for example, about 6 inches by 6 inches in its maximum dimensions and 3 inches thick. In preferred embodiments, the housing parts and centrifugal blower wheel may be die cast with aluminum to provide such an economical and lightweight construction.

While the invention has been described in a preferred embodiment, those skilled in the art will recognize that other embodiments may fall within the invention as defined by the scope of the claims that follow.

We claim:

1. A blower assembly for heating systems, comprising:

an electric motor for driving a centrifugal blower wheel about an axis of rotation, said electric motor including a stator connectable with a source of electric energy and a rotor driven by said stator and mounted on a rotatable shaft extending along the axis of rotation between a pair of shaft bearings;

a blower housing comprising a first portion carrying said electric motor stator and shaft bearings and a second portion forming a blower enclosure, an air inlet and an air outlet; and a centrifugal blower wheel carried on the rotatable shaft outboard of the shaft bearing and within the blower enclosure for moving air into the air inlet, through the blower enclosure and out of the air outlet;

said blower enclosure of said second portion of the blower housing extending rearwardly from the centrifugal blower wheel and around an axially extending portion of the first portion of the blower housing, said axially extending portion of said first portion of the blower housing including an internal surface for engaging and carrying the electric motor stator, and being adapted for heat transfer from the stator to air moving in the blower enclosure, said first portion and second portions of said blower housing and said blower wheel cooperating in providing a generally tangential path for cooling air about the first portion carrying the electric motor.

2. The blower assembly of claim 1 wherein said centrifugal blower wheel includes a wall extending radially outwardly from a shaft-engaging hub and forms a plurality of air-moving blades that project axially outwardly from said wall to edge portions extending radially within said blower enclosure between said air inlet and air outlet, and said plurality of air-moving blades have an axial width between said wall and their radially extending edge portions permitting reduction of their axial width and a selectable axial location of the centrifugal blower wheel within said blower enclosure and use of the blower assembly to provide varied air requirements.

3. The blower assembly of claim 2, wherein the shaft-engaging hub of the centrifugal blower wheel extends forwardly and rearwardly from said wall distances substantially equal to the axial width of the air-moving blades.

4. The blower assembly of claim 1 wherein said first portion of said housing comprises an axially extending circumferential wall portion including an internal surface for engaging and supporting said stator and, at one end of the axially extending circumferential wall portion, a radially inwardly-extending wall portion having a first circumferential surface for engaging and supporting one of the pair of shaft bearings, said first portion of said housing further comprising, at the other end of said axially extending circumferential wall portion, a second circumferential surface for engaging and supporting a separate end piece carrying the other of said pair of shaft bearings; and said second portion forms said blower enclosure with a first blower enclosure wall extending radially outwardly from said axially extending circumferential wall portion of said first housing portion at a location wherein said blower enclosure substantially surrounds said electric motor, said second portion further comprising a separate blower enclosure portion forming the forward portion of the blower enclosure with said air inlet.

5. The blower assembly of claim 1 wherein said first portion has a wall thickness that is reduced at said axially extending portion adjacent said internal surface.

6. A compact air blower assembly, comprising a housing forming a first portion for carrying an electric motor and a second portion for directing air between the air inlet and air outlet in said second housing portion, and a centrifugal blower wheel within said second portion driven by said electric motor to move air between the air inlet and air outlet in the second portion, said first housing portion including an axially extending circumferential wall surrounding said electric motor and in heat transfer relationship therewith, and said second housing portion forming an annular air chamber including said axially extending circumferential wall surrounding said electric motor, said first portion of said blower housing cooperating with said second portion and said blower wheel in providing a generally tangential path for cooling air about the first portion carrying the electric motor.

7. The compact air blower assembly of claim 6 wherein said first portion has a wall thickness that is reduced at said axially extending circumferential wall surrounding said electric motor.

8. A compact self-cooling blower assembly comprising a first housing part forming an axially extending annular wall portion, an annular web portion extennding radially inwardly from one end of the axially extending wall portion, and an annular portion extending outwardly of the axially extending annular wall portion from substantially rearwardly of the annular web portion and having a terminal edge portion, an electric motor stator carried within the axially extending annular wall portion of the first housing part adjacent the annular web portion, a first bearing carried by said annular web portion, a rear closure carried by the other end of the axially extending annular wall portion, a second bearing carried by the rear closure, a motor rotor and a rotatable shaft carried by said first and second bearings, said rotatable shaft having a shaft portion extending outwardly from said first bearing, a centrifugal blower wheel carried by said extending shaft portion, and a second housing part engaged with the terminal edge portion of the first housing part and forming an air inlet for said blower wheel and, with said first housing part, a chamber permitting circulation of air from said centrifugal blower wheel within said chamber and adjacent said axially extending annular wall portion for cooling said electric motor stator.

9. The compact self-cooling blower assembly of claim 8 wherein said axially extending annular wall portion has a reduced thickness around said electric motor stator for enhancing heat transfer.

* * * * *